United States Patent [19]

Mills

[11] Patent Number: 4,951,876

[45] Date of Patent: Aug. 28, 1990

[54] SPRAY TIP FOR A CAULKING TUBE

[75] Inventor: Gregory B. Mills, Santa Ana, Calif.

[73] Assignee: Behr Process Corporation, Santa Ana, Calif.

[21] Appl. No.: 308,033

[22] Filed: Feb. 9, 1989

[51] Int. Cl.[5] ..... B05B 15/02

[52] U.S. Cl. ..... 239/117; 222/630; 239/331; 239/369; 239/418; 239/433

[58] Field of Search ..... 239/307, 308, 331, 337, 239/369, 375, 117, 417.5, 418, 433, 325; 222/630, 637

[56] References Cited

U.S. PATENT DOCUMENTS

| | | | |
|---|---|---|---|
| 879,891 | 2/1908 | Paasche | 239/375 |
| 910,341 | 1/1909 | Wold | 239/375 |
| 1,273,784 | 7/1918 | Paasche | 239/375 |
| 1,849,945 | 3/1932 | Mobley et al. | 239/307 |
| 1,935,977 | 11/1933 | Geer | 239/307 |
| 2,721,763 | 10/1955 | Miner | 239/308 |
| 2,895,325 | 7/1959 | Dasetto | 239/337 |
| 3,389,838 | 6/1968 | Morra et al. | 222/630 |
| 3,508,710 | 4/1970 | [illegible] | 239/308 |
| 3,786,990 | 1/1974 | Hagfors | 239/117 |
| 4,174,068 | 11/1979 | Rudolph | 222/630 |
| 4,502,640 | 3/1985 | Nonis | 239/375 |
| 4,562,966 | 1/1986 | Smith et al. | 239/433 |

*Primary Examiner*—Andres Kashnikow
*Assistant Examiner*—Michael J. Forman
*Attorney, Agent, or Firm*—Morland C. Fischer

[57] ABSTRACT

A potentially disposable, low cost spray tip to be connected to a conventional hollow caulking tube which is loaded with a supply of relatively thick, viscous material, with or without solid particulate matter in suspension, that is to be controllably sprayed onto a desired surface (e.g. drywall). The spray tip includes a material sleeve, which is fixedly attached to the spout of the caulking tube to channel material therefrom, and an air stem, which is attached to an air source to channel a supply of air under pressure. In operation, the relatively thick, viscous material is moved into the air stream, and a mixture of air and material is uniformly and continuously sprayed through an exit orifice in the spray tip to efficiently spray the surface.

10 Claims, 5 Drawing Sheets

SPRAY TIP FOR A CAULKING TUBE

BACKGROUND OF THE INVENTION

1. Field of the Invention

This invention relates to a potentially disposable, low cost spray tip to be fixedly attached to a hollow caulking tube that is filled with a relatively thick, viscous material, with or without solid particulate matter in suspension, so that the material may be easily and controllably sprayed, under pressure, from the tube onto a desired surface.

2. Background Art

Sprayers are known in the prior art for applying a liquid material, under pressure, to a surface to be treated. However, the conventional sprayers are undesirably limited, because the liquid spraying material thereof must be characterized by a relatively low viscosity to be efficiently sprayed. That is to say, and as far as is known, conventional sprayers are not readily adapted to uniformly and continuously deliver relatively thick, viscous materials, such as, for example, texture material of the type that is commonly applied to drywall.

In additional, the conventional sprayers are relatively complex to use, costly to purchase, and subject to occasional cleaning and maintenance considerations. That is to say, existing sprayers tend to jam due to the stratification of fluid and particulate matter, because such sprayers usually rely on gravity to feed the material to the spray orifice. Should a problem arise with a conventional sprayer, it must be repaired, rather than discarded. Consequently, the spraying operation may be undesirably slowed, thereby introducing possible inefficiently and waste.

It would be more desirable to have available a disposable sprayer that is capable of controllably and easily spraying a relatively thick, viscous material, with or without solid particulate matter, onto a surface without being subjected to the aforementioned stratification, maintenance and cost limitations.

SUMMARY OF THE INVENTION

In general terms, a low cost, disposable spray tip is disclosed which is to be interconnected with a conventional hollow caulking tube. The tube is of the type that can be loaded into a standard, commerically available caulking gun. The caulking tube is filled with a relatively thick material, characterized by high viscosity and the presence or absence of suspended particulate matter, to which can be easily, controllably and continuously applied, via the spray tip, to a wall, ceiling, or other surface. The spray tip includes a material sleeve that is fixedly attached (e.g. by means of spin welding) to the spout of the caulking tube. The spray tip also includes an air stem that is a detachably connected to an air hose. The air hose is located between the spray tip and a source of air. The material sleeve and the air stem of the spray tip are joined to one another at an exit orifice through which material may be controllably sprayed onto the surface to be treated.

In operation, the caulking gun is actuated to cause material to be dispensed from the caulking tube into the material sleeve of the spray tip. The air source is concurrently operated to supply air, under pressure, into the air stem, via the air hose. A mixture of material and air is moved through the exit orifice so as to be atomized, whereby said material may be uniformly and continuously sprayed onto the surface along an accurately controlled path. An optional cleaning pin is provided to be inserted between successive spraying operations, through the air stem and the exit orifice of the spray tip. The cleaning pin cleans the exit orifice of residue material and prevents air from reaching and drying the material in the caulking tube.

DESCRIPTION OF THE PREFERRED EMBODIMENT

Figure 1:
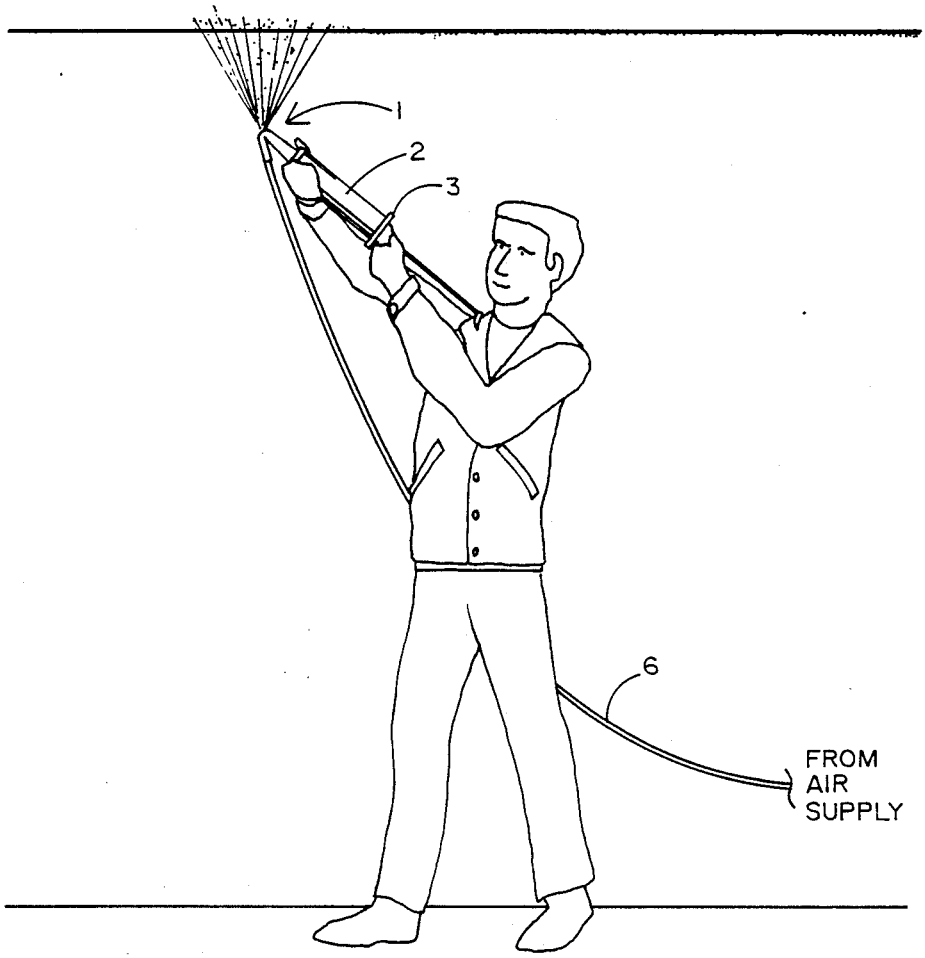
FIG. 1 is illustrative of a workman using the spray tip of the present invention to spray a surface with material.
Figure 2:
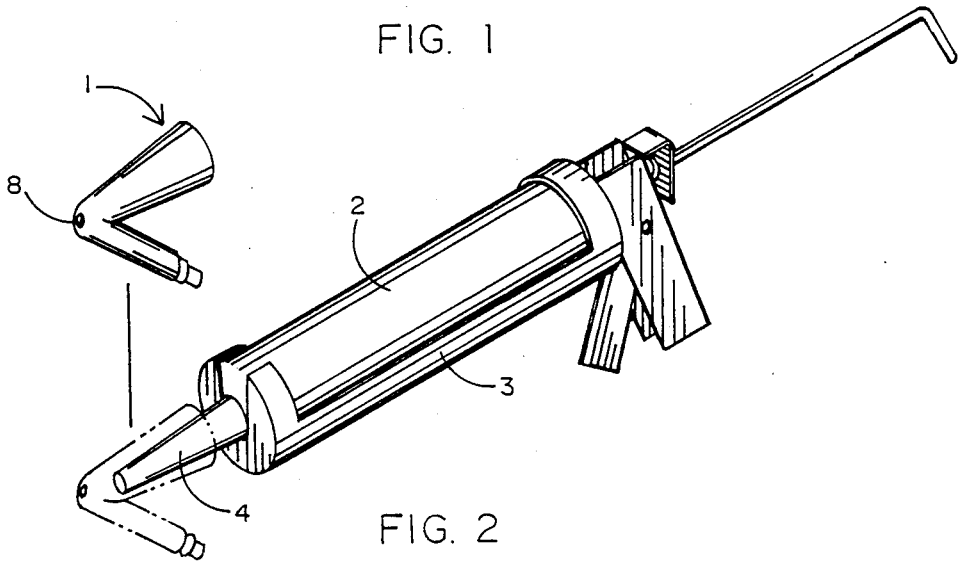
FIG. 2 shows the spray tip associated with a caulking tube that has been loaded into a conventional caulking gun.

The spray tip 1 which forms the present invention is best described while referring to the drawings where FIG. 1 illustrates a workman applying a texture material to a surface, such as a ceiling. More particularly, and referring concurrently to FIGS. 1 and 2 of the drawings, the spray tip 1 is affixed (e.g. by means of spin welding, glue, screw threads or other attachment means) to the spout 4 of a conventional, commerically available hollow caulking tube 2. The caulking tube 2 is of the type which is adapted to fit into the barrel of a standard caulking gun 3. However, instead of being loaded with caulk, the tube 2 is filled with a relatively thick, viscous material, with or without solid particulate matter in suspension, of the type that is commonly applied to drywall or a ceiling surface. The spray tip 1 is interfaced with a source of air (e.g. an air compressor having the capacity to product one cubic foot of air per minute under 25 pounds of pressure) so that air can be delivered from said source to spray tip 1 by way of a suitable air hose 6. Thus, and as will be described in greater detail hereinafter when referring to FIGS. 4 and 5, a steady stream of air, under pressure, will be mixed in spray tip 1 with the relatively thick material from caulking tube 2, such that the resulting mixture can be sprayed through an exit orifice 8 and atomized, whereby a uniform coating may be easily and continuously applied to the desired surface.

Figure 3:
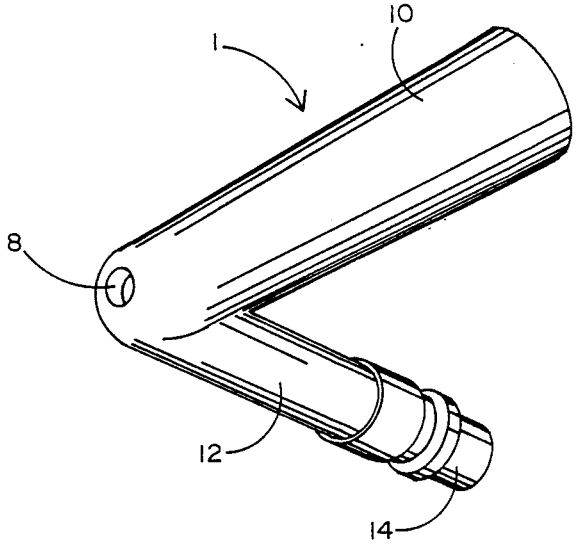
FIGS. 3 and 4 are perspective views of the spray tip.
Figure 4:
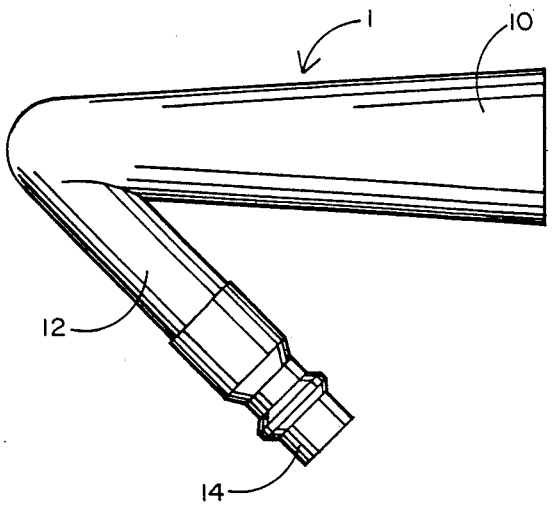

The structure of spray tip 1 is now described while referring to FIGS. 3 and 4 of the drawings. The spray tip 1 is preferably formed by a lightweight easily molded material, such as polyethylene, or the like. However, it is also preferable that spray tip 1 be formed from the same or similar material as the caulking tube to which it will be attached, because it is difficult to spin weld dissimilar materials. Of course, if spray tip 1 is to be connected to the caulking tube by means other than a spin welding technique, the materials of tip 1 and tube 2 (of FIG. 1) need not be similar.

The spray tip 1 includes a hollow material sleeve 10 and a hollow air stem 12 that are coextensively interconnected and aligned with one another at an angle (e.g. of approximately 45 degrees). The material sleeve 10 is flared so as to conform to the shape of and form a snug fit with the spout of a caulking tube. The air stem 12 is provided with a standard, quick disconnect air nipple 14 at an outward end thereof so that stem 12 may be reliably attached to an air hose (designated 6 in FIG. 1). The exit orifice 8, through which a mixture of air and material is to be sprayed, is formed in axial alignment with air stem 12 at the interface of material sleeve 10 and air stem 12.

Figure 5:
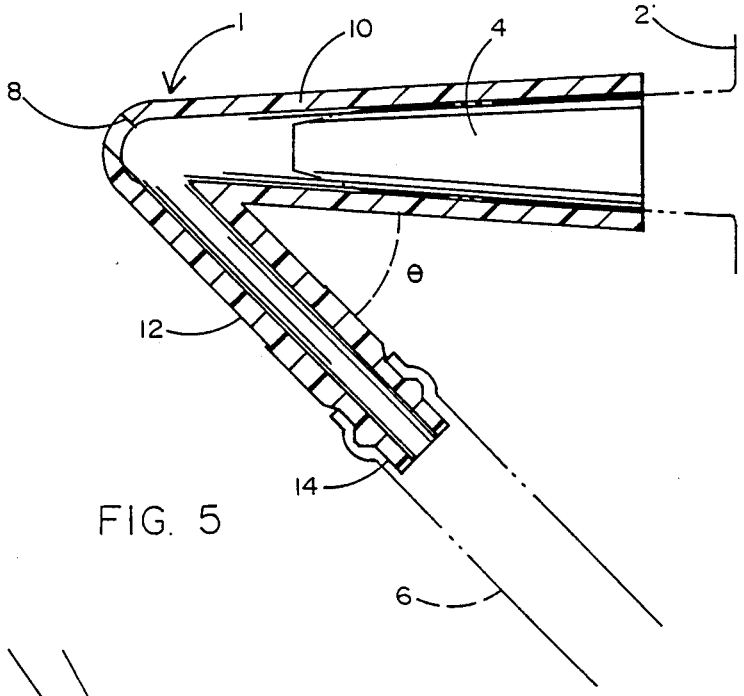
FIGS. 5 and 6 illustrate the operation of the spray tip for spraying a surface.
Figure 6:
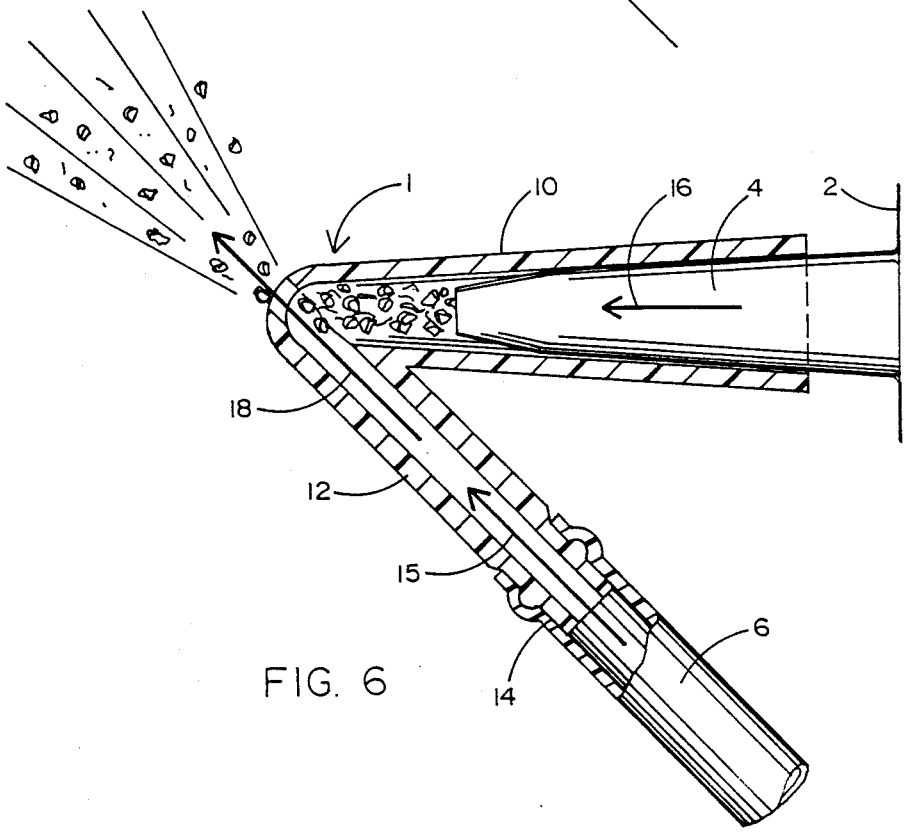

The use and operation of spray tip 1 for easily and controllably spraying a continuous coating of relatively thick, viscous material is now described while referring to FIGS. 5 and 6 of the drawings. Initially, the material sleeve 12 of spray tip 1 is affixed to the spout 4 of caulking tube 2, as previously described. Next, an air hose 6 is removably attached to the air nipple 14 at the air stem 12 of spray tip 1. The operator is now ready to use spray tip 1 for spraying the thick, viscous material by positioning the exit orifice 8 of said tip in spaced proximity (e.g. 12" to 18") to the surface to be treated.

In operation, air, under pressure, is channeled (in the direction of reference arrow 15 of FIG. 6), via air hose 6 and air stem 12, through the exit orifice 8. At the same time, the caulking gun is operated in the usual manner to cause material to be slowly and controllably dispensed (in the direction of reference arrow 16) from the caulking tube 2 for introduction, via the material sleeve 10, into the air flow at the exit orifice 8. The air and material are mixed together within the spray tip 1, and the pressure of the air forces the mixture outwardly (in the direction of the reference arrow 18) through the exit orifice 8. Accordingly, the mixture is atomized to form a spray which can be continuously and uniformly applied along an accurately controlled path to the desired surface.

After the contents of the caulking tube 2 have been emptied, the air hose 6 is detached from air nipple 14 and the caulking tube 2 is removed from the caulking gun. The tube 2, with the spray tip 1 still affixed to the spout 4 thereof, may then be discarded and replaced within the caulking gun by a new caulking tube having a fresh supply of thick, viscous material and a clean spray tip attached thereto.

Figure 7:
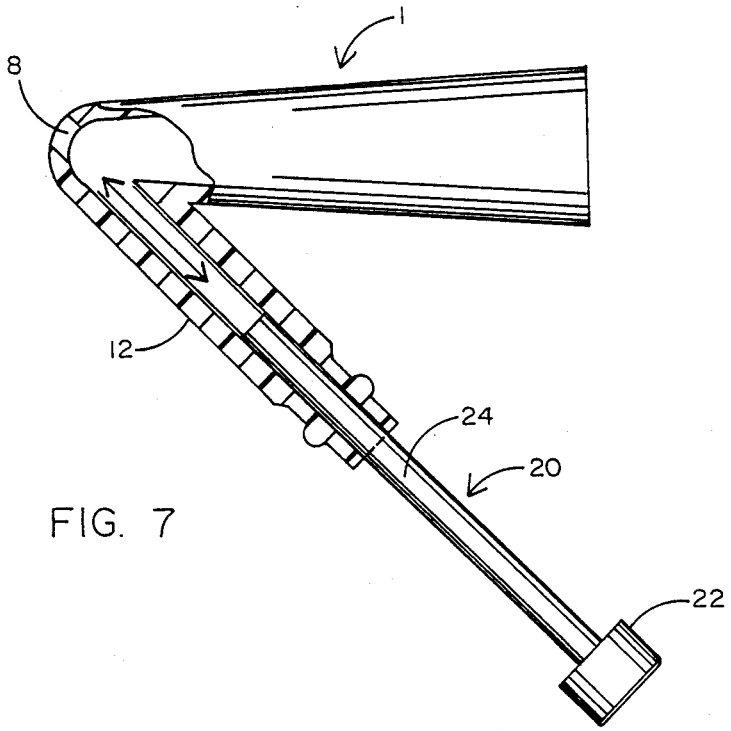
FIGS. 7 and 8 show the spray tip in removable receipt of an optional cleaning pin.
Figure 8:
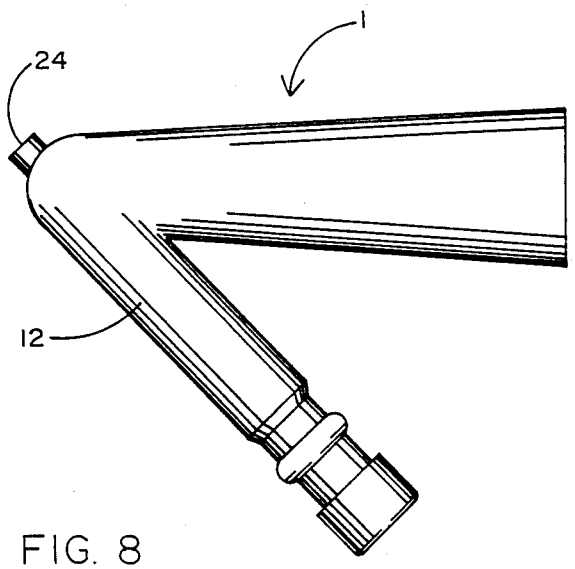

FIGS. 7 and 8 of the drawings show an extension of the present invention where a cleaning pin 20 is removably inserted through the air stem 12 and past the exit orifice 8. The cleaning pin 20 has an enlarged gripping head 22 formed at one end and an elongated stem 24 formed at the opposite end. The stem 24 is sized to pass through the interior of air stem 12 and out the orifice 8. Cleaning pin 20 has particular application when the spray tip 1 and its associated caulking tube will be reused in successive spraying operations over a period of time until the contents of the tube are completely exhausted. That is, it may be necessary to clean the exit orifice 8 of spray tip 1 to remove any residue material which might undesirably block said orifice and prevent reuse. Moreover, the cleaning pin 20 also functions as an end cap across spray tip 1 to prevent air from reaching and possibly drying the material within the caulking tube. Thus, the cleaning pin 20 is inserted through air stem 12 at the end of each spraying operation and removed therefrom at the commencement of a new operation.

By virtue of the spray tip of the present invention, a relatively thick material of characteristically high viscosity may be easily and controllably sprayed, under pressure, onto a surface in a continuous fashion so that the surface may be treated with a uniform coating of said material. The spray tip is disposable to minimize cleaning and repair considerations. Moreover, the spray tip is of low cost so that the spraying operation may be efficiently and economically completed.

Figure 9:
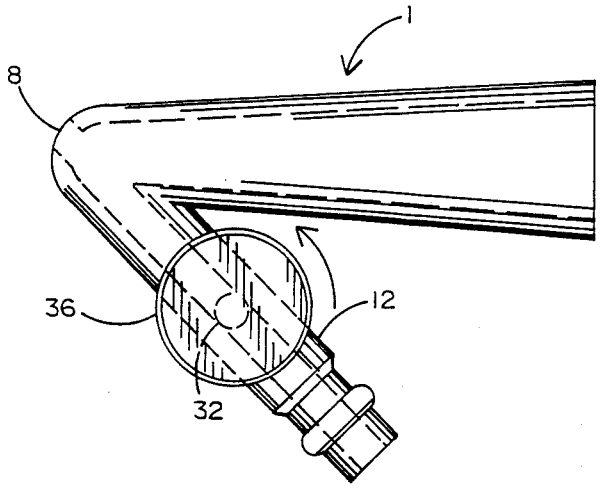
FIGS. 9 and 10 show an optional flow control valve located in the spray tip to control the flow of air therethrough.
Figure 10:
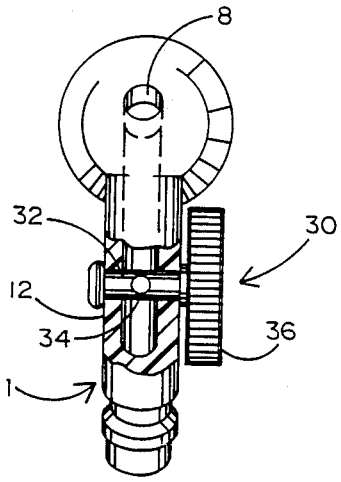

FIGS. 9 and 10 of the drawings show another extension of the present invention where a flow control valve 30 is located within the hollow air stem 12 of spray tip 1 to control the flow of air therethrough. In the embodiment illustrated, the flow control valve 30 includes a stem 32 having an opening 34 formed therethrough. The stem 32 extends completely across air stem 12 and is rotatable therewithin by means of a knurled knob 36. More particularly, by rotating knob 36, the position of opening 34 relative to the flow path of air stem 12 can be selectively controlled to corresponding adjust the volume of air flowing through stem 12 and the degree of atomization of the material being dispensed through exit orifice 8 to be sprayed onto the desired surface.

It will be apparent that while a preferred embodiment of the invention has been shown and described, various modifications and changes may be made without departing from the true spirit and scope of the invention. For example, although the spray tip hereof has been described as having application for spraying a material of the type commonly applied to a ceiling or wall surface, this is not to be considered as a limitation of the present invention. That is to say, the presently disclosed spray tip has particular application for uniformly and continuously spraying any relatively thick material characterized by high viscosity where the spraying of such material by conventional sprayers has not, heretofore, been easily accomplished.

Having thus set forth a preferred embodiment of the invention, what is claimed is:

1. A combination spray tip and supply tube, said supply tube containing a supply of relatively thick material of high viscosity to be sprayed onto a surface, said spray tip comprising:

a material tube to be interconnected with said supply tube to receive material therefrom;

an air tube to be interconnected with a source of air to receive air, under pressure, therefrom, said air and material tubes having respective flow paths which intersect one another at an angle; and an exit orifice having a uniform diameter extending through said spray tip and having the same diameter as and being coaxially aligned with said air tube to form a linear flow path therewith so that a mixture of air and material is sprayed through said exit orifice when material moves through the flow path of said material tube and air moves through the flow path of said air tube.

2. The combination recited in claim 1, wherein said supply tube is a hollow caulking tube having an exit spout.

3. The combination recited in claim 2, wherein the material tube of said spray tip is fixedly attached to the spout of said caulking tube.

4. The combination recited in claim 1, wherein said exit orifice is located at the intersection of the respective flow paths of said material and air tubes.

5. The combination recited in claim 1, wherein the respective flow paths of said material and air tubes intersect one another at an angle of approximately 45 degrees.

6. The combination recited in claim 1, wherein said supply tube is filled with a material of the type to cover drywall.

7. The combination recited in claim 1, also including a cleaning pin to be removably received through the air tube and exit orifice of said spray tip remove any residue material from said orifice and prevent air from reaching the material with said material tube.

8. The combination recited in claim 1, also including flow control means located within said air tube to control the flow of air therethrough.

9. The combination recited in claim 8, wherein said flow control means is a valve having an opening therethrough that is rotatable within said air tube to vary the volume of air flowing therethrough.

10. A spray tip to be connected to a source of material at an outlet thereof, said source containing a thick material of high viscosity to be sprayed onto a surface, said spray tip comprising:

a material tube to be connected to the outlet of said source of material to receive material therefrom;

an air tube to be connected to a source of air to receive air, under pressure, therefrom, said air and material tubes having respective axial flow paths that intersect one another at an angle;

a chamber located in the flow paths of said air and material tubes in which material from said material tube is entrained with air from said air tube; and an exit orifice having a uniform cross-section and being located at the intersection of the axial flow paths of said air and material tubes and communicating with said chamber, said exit orifice having the same diameter as and being coaxially aligned with said air tube to form a linear flow path therewith so that air and material are sprayed through said orifice without leaving a deposit of material to clog said orifice.

* * * * *